US008113609B2

(12) United States Patent
Park

(10) Patent No.: US 8,113,609 B2
(45) Date of Patent: Feb. 14, 2012

(54) GUIDE RAIL FOR REFRIGERATOR

(75) Inventor: Ji-Yong Park, Busan (KR)

(73) Assignee: LG Electronics Inc., Seoul (KR)

( * ) Notice: Subject to any disclaimer, the term of this patent is extended or adjusted under 35 U.S.C. 154(b) by 139 days.

(21) Appl. No.: 12/516,265

(22) PCT Filed: Jan. 22, 2007

(86) PCT No.: PCT/KR2007/000369

§ 371 (c)(1),
(2), (4) Date: May 26, 2009

(87) PCT Pub. No.: WO2008/091029

PCT Pub. Date: Jul. 31, 2008

(65) Prior Publication Data

US 2010/0066228 A1 Mar. 18, 2010

(51) Int. Cl.
*A47B 96/04* (2006.01)

(52) U.S. Cl. ..... 312/408; 312/334.7; 312/410

(58) Field of Classification Search ..... 312/402, 312/404, 408, 410, 334.1, 334.4, 334.5, 334.7; 62/382, 440, 441; 211/151, 26.15
See application file for complete search history.

(56) References Cited

U.S. PATENT DOCUMENTS

| | | | | | |
|---|---|---|---|---|---|
| 1,975,327 | A | * | 10/1934 | Loney | 312/408 |
| 2,682,754 | A | * | 7/1954 | Eck | 62/531 |
| 2,801,146 | A | * | 7/1957 | Mikulas | 312/301 |
| 3,054,645 | A | * | 9/1962 | Evans | 384/42 |
| 3,059,986 | A | * | 10/1962 | Miller, Jr. | 312/334.8 |
| 3,321,253 | A | * | 5/1967 | Everburg | 384/23 |
| 3,738,725 | A | * | 6/1973 | Visser | 312/246 |
| 3,813,132 | A | * | 5/1974 | Sahm | 384/42 |
| 4,152,034 | A | * | 5/1979 | Dunning, III | 312/204 |
| 4,936,641 | A | * | 6/1990 | Bussan et al. | 312/408 |
| 5,040,856 | A | * | 8/1991 | Wilkins et al. | 312/402 |
| 5,346,299 | A | * | 9/1994 | Werkmeister et al. | 312/405.1 |
| 5,366,284 | A | * | 11/1994 | Baker et al. | 312/404 |
| 5,918,959 | A | * | 7/1999 | Lee | 312/404 |
| 7,240,980 | B2 | * | 7/2007 | Koons | 312/404 |
| 2001/0054296 | A1 | * | 12/2001 | Kaiser | 62/373 |
| 2006/0192469 | A1 | * | 8/2006 | Koo | 312/330.1 |
| 2007/0228911 | A1 | * | 10/2007 | Kim et al. | 312/408 |

FOREIGN PATENT DOCUMENTS

| | | | | |
|---|---|---|---|---|
| CN | 101231087 | | * | 7/2008 |
| KR | 20-0170034 | Y1 | | 3/2000 |
| KR | 20-0195815 | Y1 | | 10/2000 |
| KR | 10-2006-0075816 | A | | 7/2006 |
| KR | 10-2007-0681504 | | * | 2/2007 |
| KR | 10-2007-0042347 | | * | 4/2007 |

* cited by examiner

*Primary Examiner* — Darnell Jayne
*Assistant Examiner* — Kimberley S Wright
(74) *Attorney, Agent, or Firm* — Birch, Stewart, Kolasch & Birch LLP

(57) ABSTRACT

A guide rail for a refrigerator includes a rail body having a back face to be brought into close contact with a side surface of an inner case defining a storage space of the refrigerator; a guide portion provided in the rail body so that the guide portion extends in front of a guide rib formed to be elongated in a fore and aft direction on the side surface of the inner case, thereby guiding the movement of a receiving container to be accommodated in or taken out from the storage space; and a seating space provided in the rail body so that a portion of the guide rib is inserted into the seating space when the back face of the rail body is brought into close contact with the side surface of the inner case.

8 Claims, 5 Drawing Sheets

GUIDE RAIL FOR REFRIGERATOR

TECHNICAL FIELD

The present invention relates to a refrigerator, and more particularly, to a guide rail for a refrigerator, which guides the movement of a receiving container that is accommodated in or taken out from a storage space of the refrigerator.

BACKGROUND ART

A refrigerator is an electric home appliance for keeping foods in a fresh state for a long time by freezing or refrigerating the foods. In the refrigerator, there is provided a storage space for storing foods to be refrigerated or frozen. A receiving container such as a vegetable box is installed in the storage space such that the receiving container can be accommodated in or taken out from the storage space. Furthermore, guide rails for guiding the vegetable box or the like are installed on both side surfaces defining the storage space.

FIG. 4 is a perspective view showing a state where a conventional guide rail for a refrigerator is mounted in a storage space. FIG. 5 is a perspective view showing the conventional guide rail when viewed at the rear of the guide rail. FIG. 6 is a perspective view showing a state where the conventional guide rail mounted in the storage space is used.

As shown in these figures, guide ribs 11 are provided at the same level on both side surfaces of an inner case 10 that defines a storage space of a refrigerator. The guide ribs 11 are formed to protrude in a direction in which the both side surfaces of the inner case 10 face each other, i.e., toward the interior of the storage space, and to be elongated in a fore and aft direction. The guide ribs 11 are to substantially guide a receiving container 40 (see FIG. 6) that is accommodated in or taken out from the storage space.

Each of the guide ribs 11 includes an upper guide rib 13 and a lower guide rib 15. The upper guide rib 13 and the lower guide rib 15 are provided to be vertically spaced apart by a certain distance from each other. Furthermore, the lower guide rib 15 more extends forward relative to the upper guide rib 13. Moreover, a lower portion of the lower guide rib 15 is provided with an inclined portion 15A that is inclined downwardly toward the inner case 10.

Further, a fastening hole (not shown) and a pair of fastening grooves (not shown) are formed in a region on each of the both side surfaces of the inner case 10 in the vicinity of the guide rib 11. A screw S1 penetrating a through-hole 21H, which will be described later, is screwed into the fastening hole. Furthermore, locking hooks 22 that will be described later are fastened to the fastening grooves.

Guide rails 20 are installed in regions on the both side surfaces of the inner case 10 in front of the guide ribs 11. The guide rails 20 function to substantially extend the lengths of the guide ribs 11. To this end, when the guide rails 20 are installed on the both side surfaces of the inner case 10, rear ends of the guide rails 20 abut on front ends of the guide ribs 11.

Rail bodies 21 of the guide rails 20 are formed to be elongated in a lengthwise direction, and back faces of the rail bodies are in close contact with the both side surfaces of the inner case 10. The through-hole 21H is formed at a side of each of the rail bodies 21. The through-hole 21H is a hole through which the screw S1 to be screwed into the fastening hole penetrates.

Meanwhile, as shown in FIG. 5, the pair of locking hooks 22 is provided on the back face of each of the rail bodies 21. On the back face of the rail body 21, the locking hooks 22 are positioned to be spaced apart from each other by a predetermined distance with respect to the through-hole 21H. Each of the locking hooks 22 is formed of a pair of hook members that are vertically spaced apart by a certain distance from each other so as to be elastically deformed. The locking hooks 22 are inserted into the fastening grooves in a state where the back faces of the rail bodies 21 are brought into close contact with the both side surfaces of the inner case 10.

Furthermore, opposite surfaces of the guide rail 20 are provided with an upper guide portion 23 and a lower guide portion 25. The upper guide portion 23 is formed to be elongated in the fore and aft direction at the same level as the upper guide rib 13. Furthermore, the lower guide portion 25 is formed to be elongated in the fore and aft direction at the same level as the lower guide rib 15.

As shown in FIG. 6, the upper guide ribs 13 and the upper guide portions 23 are to support a shelf 30. The shelf 30 is accommodated in or taken out from the storage space while being moved in the fore and aft direction in a state where both side ends of a bottom surface of the shelf are supported on upper surfaces of the upper guide ribs 13 and the upper guide portions 23. Furthermore, the lower guide ribs 15 and the lower guide portions 25 are to support a receiving box 40. That is, the receiving box 40 is accommodated in or taken out from the storage space while being moved in the fore and aft direction of the storage space in a state where support ribs provided at upper ends of both side surfaces of the receiving box 40 are supported on upper surfaces of the lower guide ribs 15 and the lower guide portions 25.

However, such a conventional guide rail for a refrigerator has the following problems.

As described above, the receiving box 40 is moved in the fore and aft direction within the storage space in the state where the support ribs are supported by the upper guide ribs 13 and the upper guide portions 23. However, since foods are contained in the receiving box 40, a load may be concentrated only on any one of the upper guide rib 13 and the upper guide portion 23 in the process of moving the receiving box 40 in the fore and aft direction within the storage space. That is, in a state where a front end of the receiving box 40 is taken out from the storage space and only a rear end of the receiving box 40 is supported by the upper guide portion 23, a load of the receiving box 40 may be concentrated only on a front end of the upper guide portion 23.

However, since the guide rails 20 are fixed to the both side surfaces of the inner case 10 by the screws S1, the guide rails 20 are rotated about the screws S1 by the load of the receiving box 40. Thus, the guide rails 20 cannot be maintained in a horizontal state, so that the guide rails 20 cannot correctly guide the movement of the receiving box 40.

Furthermore, if the guide rails 20 are rotated about the screws S1 and thus cannot be maintained in the horizontal state, certain external forces are also exerted on the locking hooks 22 that are inserted into the fastening grooves. Hence, the inner case 10 and/or the guide rails 20 may be damaged.

DISCLOSURE

Technical Problem

The present invention is conceived to solve the aforementioned problems in the prior art. An object of the present invention is to provide a guide rail for a refrigerator, which is constructed to secure the operational reliability of a product.

Another object of the present invention is to provide a guide rail for a refrigerator, which is constructed to secure the durability of a product.

Technical Solution

According to an aspect of the present invention for achieving the objects, there is provided a guide rail for a refrigerator, comprising a rail body having a back face to be brought into close contact with a side surface of an inner case defining a storage space of the refrigerator, a guide portion provided in the rail body so that the guide portion extends in front of a guide rib formed to be elongated in a fore and aft direction on the side surface of the inner case, thereby guiding the movement of a receiving container to be accommodated in or taken out from the storage space, and a seating space provided in the rail body so that a portion of the guide rib is inserted into the seating space when the back face of the rail body is brought into close contact with the side surface of the inner case.

ADVANTAGEOUS EFFECTS

According to the present invention thus constructed, there is an advantage in that it is possible to secure the operational reliability and durability of a product.

BEST MODE

Hereinafter, preferred embodiments of a guide rail for a refrigerator according to the present invention will be described in detail with reference to the accompanying drawings.

Figure 1:
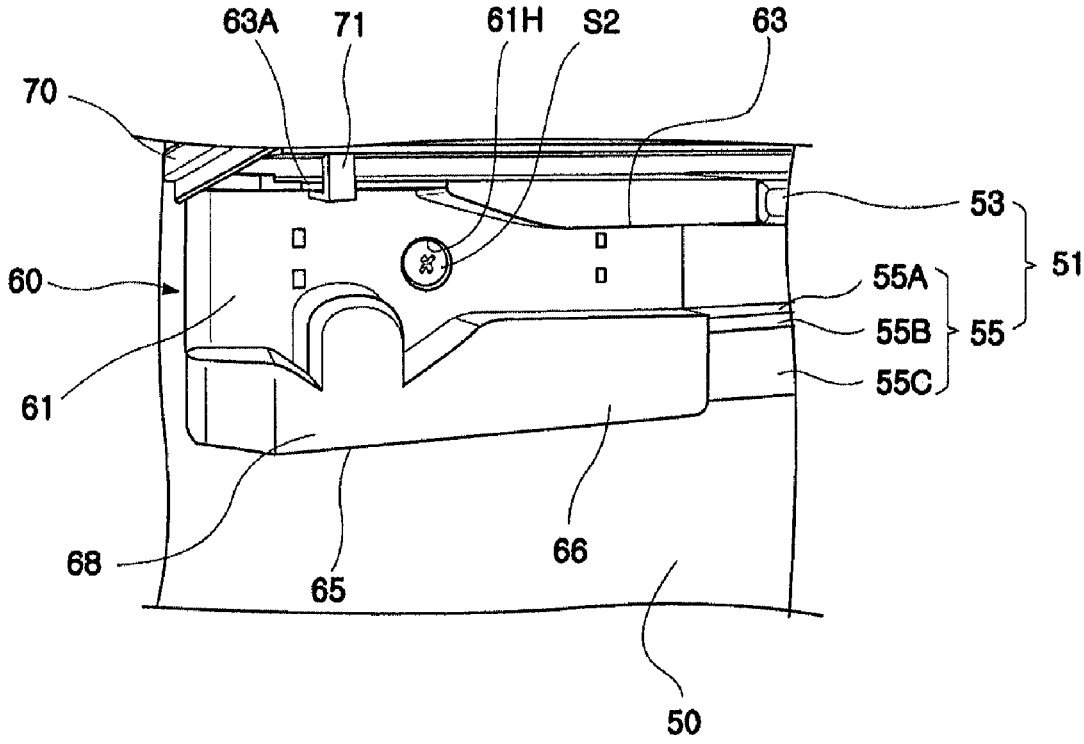
FIG. 1 is a perspective view showing a state where a guide rail for a refrigerator according to a preferred embodiment of the present invention is installed in a storage space.
Figure 2:
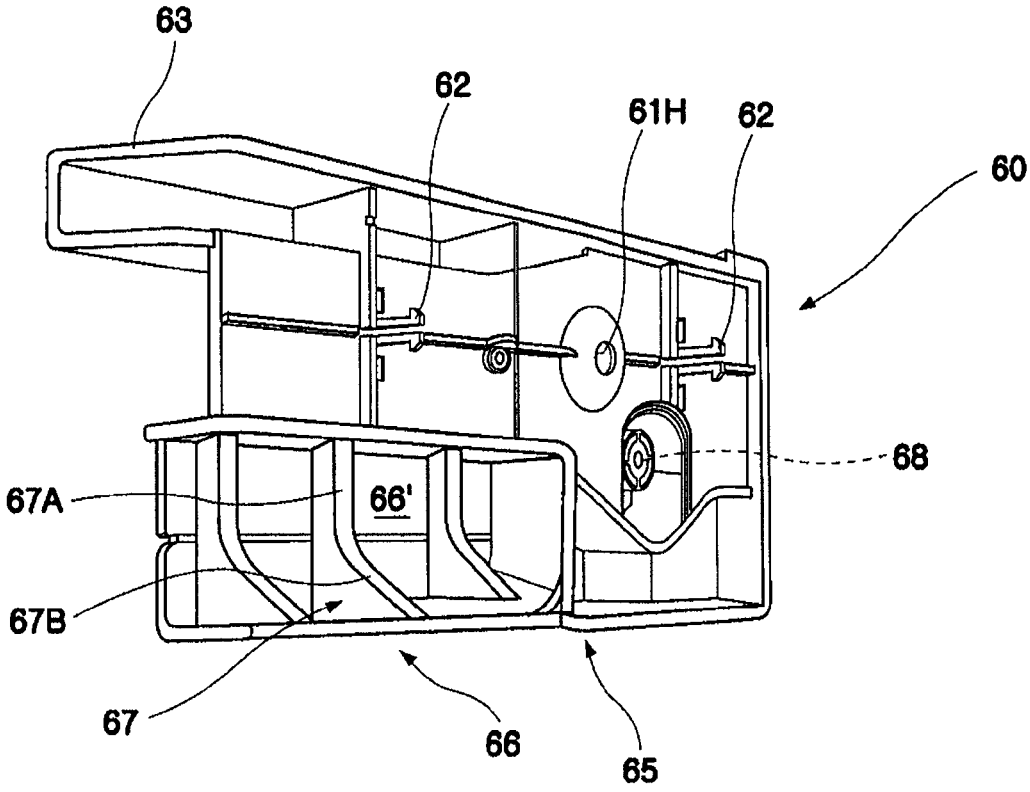
FIG. 2 is a perspective view showing the guide rail according to the preferred embodiment of the present invention when viewed at the rear of the guide rail.
Figure 3:
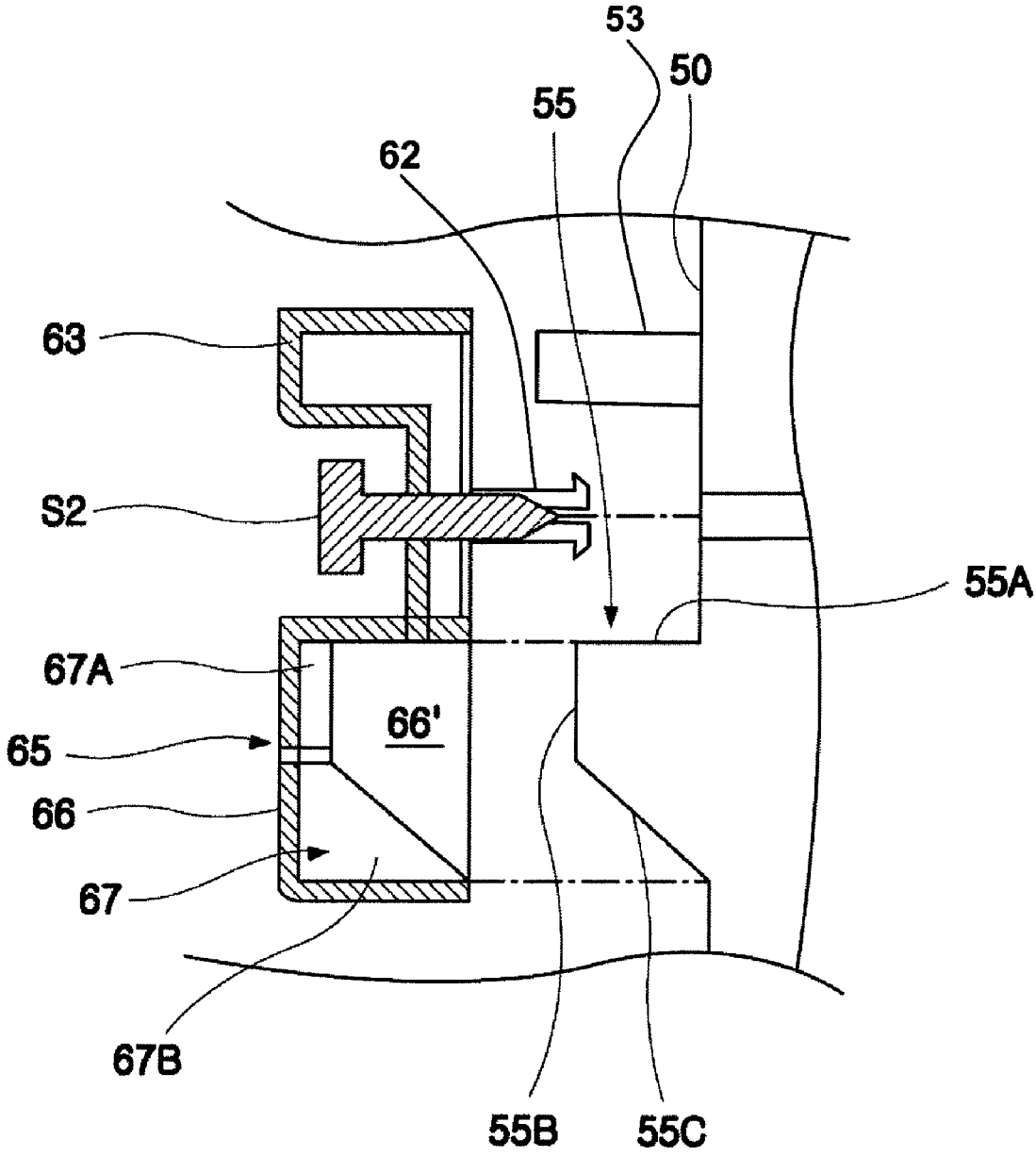
FIG. 3 is an exploded perspective view showing the guide rail according to the preferred embodiment of the present invention.
Figure 4:
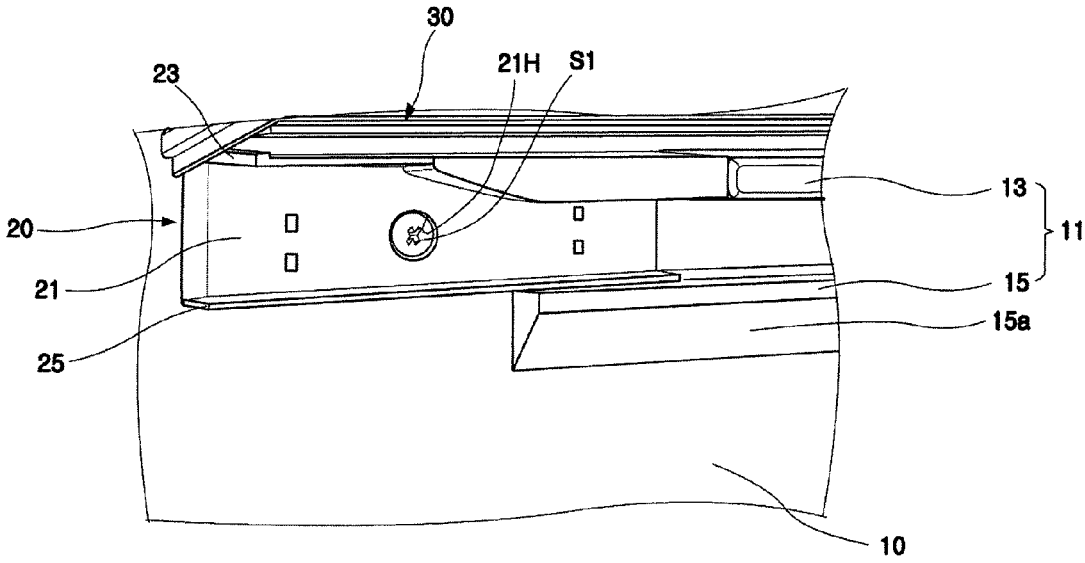
FIG. 4 Conventional Art
FIG. 4 is a perspective view showing a state where a conventional guide rail for a refrigerator is mounted in a storage space.
Figure 5:
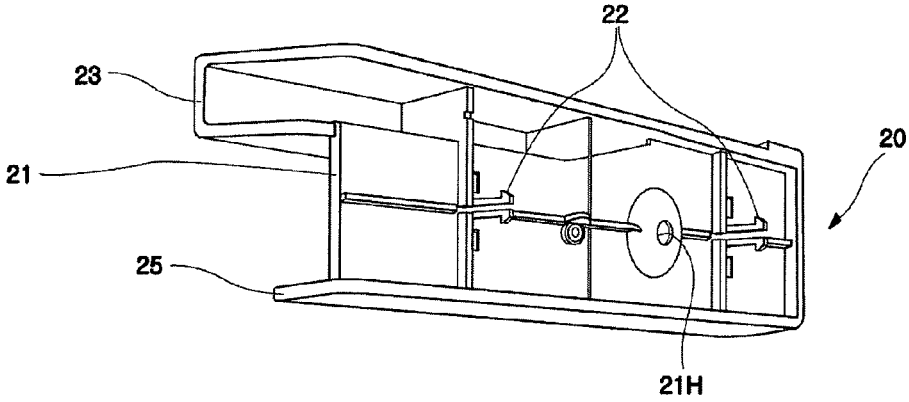
FIG. 5 Conventional Art
FIG. 5 is a perspective view showing the conventional guide rail when viewed at the rear of the guide rail.
Figure 6:
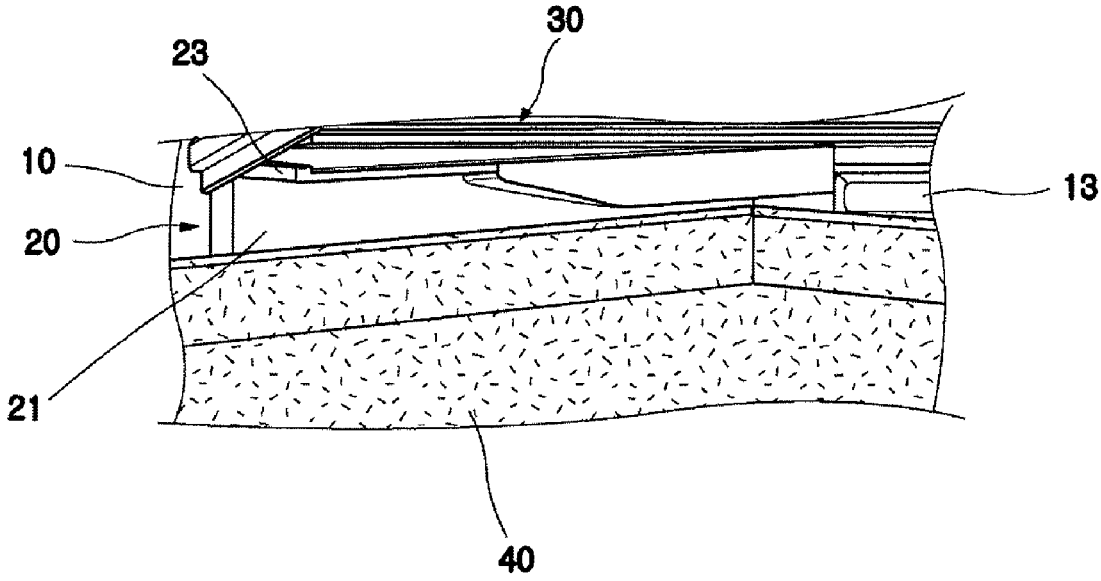
FIG. 6 Conventional Art
FIG. 6 is a perspective view showing a state where the conventional guide rail mounted in the storage space is used.

FIG. 1 is a perspective view showing a state where a guide rail for a refrigerator according to a preferred embodiment of the present invention is installed in a storage space, FIG. 2 is a perspective view showing the guide rail according to the preferred embodiment of the present invention when viewed at the rear of the guide rail, and FIG. 3 is an exploded perspective view showing the guide rail according to the preferred embodiment of the present invention.

As shown in these figures, guide ribs 51 are provided on both side surfaces of an inner case 50 that defines a storage space of a refrigerator. The guide ribs 51 are formed to be elongated in a fore and aft direction within the storage space. Each of the guide ribs 51 includes an upper guide rib 53 and a lower guide rib 55 which are located to be vertically spaced apart by a certain distance from each other. Furthermore, the lower guide rib 55 more extends forward relative to the upper guide rib 53.

The upper guide rib 53 and the lower guide rib 55 are to substantially guide a shelf 70 and a receiving box 40 (see FIG. 2) which are installed to be accommodated in or taken out from the storage space. Furthermore, the upper guide rib 53 and the lower guide rib 55 are formed in such a manner that a portion of the inner case 50 protrudes in a predetermined shape toward the interior of the storage space, and an insulating layer (not shown) is formed in a space corresponding to the interior of each of the upper and lower guide ribs 53 and 55.

The lower guide rib 55 has an upper surface 55A, a side surface 55B and an inclined portion 55C, which define an approximately trapezoidal longitudinal section. The upper surface 55A extends horizontally from the side surface of the inner case 50. The side surface 55B extends vertically at an edge of the upper surface 55A, and the inclined portion 55C extends from a lower end of the side surface 55B so as to be inclined downwardly at a predetermined angle toward the side surface of the inner case 50.

Guide rails 60 are installed in regions in front of the guide ribs 51 on the both side surfaces of the inner case 50. The guide rails 60 substantially cause the lengths of the guide ribs 51 to extend forward, thereby functioning to guide the movement of the receiving box 40.

Rail bodies 61 of the guide rails 60 are formed to have a predetermined length, and back faces of the rail bodies are in close contact with the both side surfaces of the inner case 50. A through-hole 61H and a pair of locking hooks 62 are formed in each of the rail bodies 61. The through-hole 61H is a hole through which a screw S2 to be screwed into a fastening hole (not shown) formed in each of the both side surfaces of the inner case 50 penetrates in a state where the back face of the rail body 61 is brought into close contact with each of the both side surfaces of the inner case 50. The locking hooks 62 are provided in regions on the rear face of the rail body 61 which are on both sides with respect to the through-hole 61. The locking hooks 62 are inserted into fastening grooves (not shown) formed on the both side surfaces of the inner case 50 in the state where the back faces of the rail bodies 61 are brought into close contact with the both side surfaces of the inner case 50.

Moreover, each of the guide rails 61 is provided with an upper guide portion 63 and a lower guide portion 65. The upper guide portion 63 and the lower guide portion 65 are formed to be elongated in the fore and aft direction at the same levels as the upper guide rib 53 and the lower guide rib 55, respectively. Hence, the lengths of the upper and lower guide ribs 53 and 55 are extended in the fore and aft direction by the upper and lower guide portions 63 and 65.

Here, the upper guide ribs 53 and the upper guide portions 63 are to support the shelf 70. To this end, both side ends of a bottom surface of the shelf 70 are supported on upper surfaces of the upper guide ribs 53 and the upper guide portions 63. The shelf 70 is moved in the fore and aft direction within the storage space in the state where the both side ends of the bottom surface of the shelf are supported on the upper surfaces of the upper guide ribs 53 and the upper guide portions 63.

Each of the upper guide portions 63 is formed with a shelf guide groove 63A for guiding each of the side ends of the bottom surface of the shelf such that the side end is seated on the upper surface of the upper guide portion 63 in the process of mounting the shelf 70 in the storage space. Furthermore, catching hooks 71, which are to be caught by bottom surfaces of the upper guide portions 63, are provided at front regions of the both side ends of the bottom surface of the shelf 70.

Support ribs (not shown) provided at upper ends of both side surfaces of the receiving box 40 are supported on the upper surfaces of the lower guide ribs 55 and the lower guide portions 65. Furthermore, the receiving box 40 is moved in the fore and aft direction within the storage space in a state where the support ribs are supported on the upper surfaces of the lower guide ribs 55 and the lower guide portions 65.

Meanwhile, a rear end of the lower guide portion 65 is provided with a support portion 66. Furthermore, a seating space 66' is provided in a region on the back face of the rail body 61 corresponding to the support portion 66. The seating space 66' is a space in which a front end of the lower guide rib 55 is seated in a state where the back face of the rail body 61 is brought into close with the side surface of the inner case 50. The seating space 66' is defined by the lower guide portion 66 that is formed by depressing a portion of the rail body 61 in a direction far away from the side surface of the inner case 50.

A plurality of contact ribs 67 are formed in a region on the back face of the rail body 61 corresponding to the interior of the seating space 66'. The contact ribs 67 function to support the support portion 66 while being brought into close contact with the front end of the lower guide rib 55 that is seated in the seating space 66'.

Each of the contact ribs 67 includes a front contact portion 67A that is brought into close contact with the front surface 55B and an inclined contact portion 67B that is brought into close contact with the inclined portion 55C. The front contact portion 67A extends vertically on the back face of the rail body 61, and the inclined contact portion 67B extends to be inclined downwardly at a predetermined angle from a lower end of the front contact portion 67A toward the side surface of the inner case 50. Furthermore, the ceiling of the seating space 66' is brought into close contact with the upper surface 55A in a state where the lower guide portion 55 is seated in the seating space 66'.

Furthermore, the rail body 61 is provided with a roller 68. The roller 68 is formed by protruding upwardly in a region where a part of the lower guide portion 65 is depressed downwardly. The roller 68 is to further facilitate the movement of the receiving box 40 along the lower guide rib 55 and the lower guide portion 65. To this end, it is preferred that the level of an upper end of an outer periphery surface of the roller 68 be the same as or higher than that of the upper surface of the lower guide portion 65.

Hereinafter, the operation of the guide rail for a refrigerator according to the preferred embodiment of the present invention will be described in greater detail.

First, the process of mounting the guide rail for a refrigerator according to the preferred embodiment of the present invention will be described.

The guide rail 60 is moved such that the back face thereof is brought into close contact with the side surface of the inner case 50. At this time, the through-hole 61H is positioned to communicate with the fastening hole, and the locking hooks 62 are inserted into the fastening grooves. Furthermore, the guide rail 60 is fixed to the side surface of the inner case 50 by causing the screw S2 to penetrate through the through-hole 61H and to be fastened into the fastening hole.

The lower guide rib 55 is seated in the seating space 66' in a state where the back face of the guide rail 60 is in close contact with the side surface of the inner case 50. In such a state where the lower guide rib 55 is seated in the seating space 66', the contact rib 67 is in close contact with the lower guide rib 55.

Next, the process of causing a storage container to be accommodated in or taken out from a storage space by using the guide rail for a refrigerator according to the preferred embodiment of the present invention will be described.

As described above, the shelf 70 or the receiving box 40 is mounted in the storage space in a state where the guide rails 60 are installed on the both side surfaces of the inner case 50. At this time, the shelf 70 is mounted in the storage space in such a manner that the both side ends of the bottom surface of the shelf 70 are supported on the upper surfaces of the upper guide ribs 53 and the upper guide portions 63. Furthermore, the receiving box 40 is mounted in the storage space in such a manner that the support ribs are supported on the upper surfaces of the lower guide ribs 55 and the lower guide portions 65.

Meanwhile, in order to use the receiving box 40, the receiving box 40 is moved in the fore and aft direction within the storage space. At this time, the receiving box 40 is moved in the fore and aft direction within the storage space in the state where the support ribs are supported by the lower guide ribs 55 and the lower guide portions 65.

When the receiving box 40 is moved forward from the storage space in a state where foods are contained in the receiving box, a load resulting from the weight of the receiving box 40 and foods contained therein may be concentrated on the lower guide portion 65. However, as described above, the guide rail 60 is supported by the screw S2 and the locking hooks 62 as well as the lower guide rib 55 seated in the seating space 66'. Hence, even though a load is concentrated on the lower guide portion 65 in the process of causing the receiving box 40 to be accommodated in or taken out from the storage space, it is possible to prevent the occurrence of a phenomenon in which the guide rail deviates from its correct position as the rear end of the guide rail 60 is lifted relatively with respect to the front end thereof.

The scope of the present invention is not limited to the embodiment described above but is defined by the appended claims. It will be apparent that those skilled in the art can make various modifications and changes thereto within the scope of the invention defined by the claims.

INDUSTRIAL APPLICABILITY

With the guide rail for a refrigerator according to the present invention thus constructed, the following advantages can be expected.

In the present invention, since the guide rib formed on the side surface of the inner case is seated in the seating space provided in the guide rail, it is possible to prevent the occurrence of a phenomenon in which the guide rail deviates from its correct position, even though a load of the receiving container is concentrated on one side of the guide rail. Hence, the movement of the receiving container guided by the guide rails can be more smoothly performed, resulting in improvement of the operational reliability of a product.

Furthermore, since the guide rail is prevented from deviating from its correct position, deformation of or damage to the guide rails and/or a structure for fixing the guide rails is avoided. Hence, the durability of a product can be improved.

The invention claimed is:

1. A guide rail in a refrigerator, comprising:

a rail body having a back face to be brought into contact with a side surface of an inner case defining a storage space of the refrigerator;

a guide portion provided in the rail body so that the guide portion extends in front of a guide rib formed to be elongated in a fore and aft direction on the side surface of the inner case, thereby guiding the movement of a receiving container to be accommodated in or taken out from the storage space;

a seating space provided in the rail body so that a portion of the guide rib is inserted into the seating space when the back face of the rail body is brought into contact with the side surface of the inner case; and at least one contact rib to be brought into contact with the guide rib is provided in a region on the back face of the guide rail corresponding to the interior of the seating space, wherein the contact rib comprises:

a side contact portion to be brought into contact with a side surface of the guide rib arranged in parallel with the side surface of the inner case; and an inclined contact portion to be brought into contact with an inclined portion of the guide rib extending to be inclined downwardly at a predetermined angle from a lower end of the side surface of the guide rib toward the side surface of the inner case, wherein the guide portion comprises an upper guide portion and a lower guide portion that correspond respectively to an upper guide rib and a lower guide rib provided on the side surface of the inner case while being vertically spaced apart by a predetermined distance from each other.

2. The guide rail as claimed in claim 1, wherein the seating space is formed in such a manner that a portion of the rail body is depressed in a direction far away from the side surface of the inner case.

3. The guide rail as claimed in claim 2, wherein the seating space is formed in a region on the back face of the rail body corresponding to a support portion provided at a rear end of the lower guide portion.

4. The guide rail as claimed in claim 1, wherein the contact rib is formed in a shape corresponding to a longitudinal section of the guide rib.

5. The guide rail as claimed in claim 1, further comprising a U-shaped hump provided in the rail body so as to guide the movement of the receiving container.

6. The guide rail as claimed in claim 5, wherein the U-shaped hump is provided in a region of the guide portion where a part of the guide portion is depressed downwardly, so that an upper end of an outer peripheral surface of the U-shaped hump is positioned at least at the same level as an upper surface of the guide portion.

7. The guide rail as claimed in claim 1, wherein the rail body is formed with a through-hole through which a screw to be screwed into a fastening hole formed in the side surface of the inner case penetrates.

8. The guide rail as claimed in claim 7, wherein locking hooks to be inserted into fastening grooves formed in the inner case are provided in regions on the back face of the rail body on both sides with respect to the through-hole.

* * * * *